United States Patent [19]

Foit

[11] Patent Number: 4,953,721

[45] Date of Patent: Sep. 4, 1990

[54] ANTI-SWAY CRANE REEVING APPARATUS

[75] Inventor: Vilem Foit, Greenfield, Wis.

[73] Assignee: Harnischfeger Corporation, Brookfield, Wis.

[21] Appl. No.: 281,590

[22] Filed: Dec. 9, 1988

[51] Int. Cl.[5] ..... B66C 13/06

[52] U.S. Cl. ..... 212/147; 212/148

[58] Field of Search ..... 212/146, 147, 148, 213

[56] References Cited

U.S. PATENT DOCUMENTS 3,945,503 3/1976 Cooper ..... 212/147

4,376,487 3/1983 Van Soest et al. ..... 212/146

*Primary Examiner*—Sherman D. Basinger

*Assistant Examiner*—Thomas J. Brahan

*Attorney, Agent, or Firm*—Richard C. Ruppin

[57] ABSTRACT

An anti-sway crane reeving apparatus is disclosed in which a reeving apparatus is connected between an overhead frame carried by a crane, a winding drum mounted on the frame, and a lifting beam positioned below the frame from which a load carrying means is suspended. A plurality of upper spaced-apart sheaves are affixed to the overhead frame and a plurality of lower spaced-apart sheaves are affixed to the lifting beam. Each of the lower sheaves has first and second grooves. A rope means is affixed to the drum means and overhead frame and extends between the drum and the lower sheaves and between the upper and lower sheaves. The rope means includes a plurality of pairs of first and second ropes having a reeving path extending to and wrapping in the same direction around the first and second grooves of each of the lower sheaves. Each pair of first and second ropes extends from the lower sheaves in directions transverse to the axis of the sheaves and away from each other relative to the vertical. The ropes wrapping each lower sheave are under tension and in friction engagement with the lower sheave around which they wrap. They thus apply friction forces to the lower sheave and lifting beam which opposes swaying forces on the sheave and lifting beam.

15 Claims, 2 Drawing Sheets

ANTI-SWAY CRANE REEVING APPARATUS

FIELD OF THE INVENTION

This invention relates to an anti-sway crane reeving apparatus and, in particular, to a reeving apparatus in which a load lifting means is suspended from a lifting beam and the reeving apparatus is connected between the lifting beam, an overhead frame carried by the crane, and a winding drum mounted on the frame.

DESCRIPTION OF THE PRIOR ART

In current crane designs, there is an emphasis on high capacity which has been attained by increasing the travel speed of the crane upon its rails and increasing the speed of the load carrying trolley suspended from the frame of the crane. In addition, lifting heights have been raised to thereby increase the amount of material which the crane can span. However, these high speeds and high lifts increase swaying problems of the load lifting means and the load carried by the lifting means which are suspended by a reeving arrangement from the trolley of the crane. During acceleration of the crane on its tracks and acceleration of the trolley on its rails on the frame, and particularly during rapid deceleration of the crane frame or the trolley, the load carrying means and load suspended from the reeving is subject to swaying in directions parallel to the movement of the crane frame and the trolley. A high lift ability and consequent long ropes of the reeving increase the amplitude of the sway. Where the crane is of the gantry type such as a portal crane handling logs, the picking up of the logs from the side of a pile or the carrying of an unbalanced log load can also result in rotational swaying of the load carrying means and log load which is exacerbated by long reeving ropes.

Reeving arrangements presently in use which are intended to prevent swaying generally have inadequate stiffness to be effective in current fast and high cranes. The resulting swaying presents a danger of damage to the crane and to the load being carried by the crane. Also, substantial swaying results in a prolonged time cycle of the operation and in excessive rope wear since the ropes tend to jump out of the winding grooves of the crane or rub against sheave flanges or rope guards due to excessive fleet angles.

SUMMARY OF THE INVENTION

It is a general object of this invention to provide a reeving apparatus for suspending a lifting beam in which the ropes have a reeving path providing a high level of stiffness against swaying of the lifting beam and the load carrying means and load suspended from the lifting beam.

The invention is carried out by providing a reeving apparatus connected to an overhead frame carried by a crane, a winding drum means mounted on the frame, and a lifting beam positioned below the frame and from which a load carrying means is suspended. A plurality of upper spaced-apart sheaves are affixed to the overhead frame and a plurality of lower spaced-apart sheaves are affixed to the lifting beam. Each of the lower sheaves has first and second grooves. A rope means is affixed to the drum means and overhead frame and extends between the drum means and the lower sheaves and between the upper and lower sheaves. The rope means includes a plurality of pairs of first and second ropes having a reeving path extending to and wrapping in the same direction around the first and second grooves of each of the lower sheaves. Each pair of first and second ropes extend from the lower sheaves in directions away from each other relative to the vertical.

The ropes wrapping each lower sheave are under tension and in friction engagement with the lower sheave around which they wrap. They thus apply friction forces to the lower sheave and lifting beam which opposes swaying forces on the sheave and lifting beam. The forces applied by each rope pair are in opposite directions and due to the wrapping of both ropes around a lower sheave the energy of the sway is dissipated by friction between the ropes and sheaves, thus significantly decreasing the amplitude of each succeeding sway movement.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
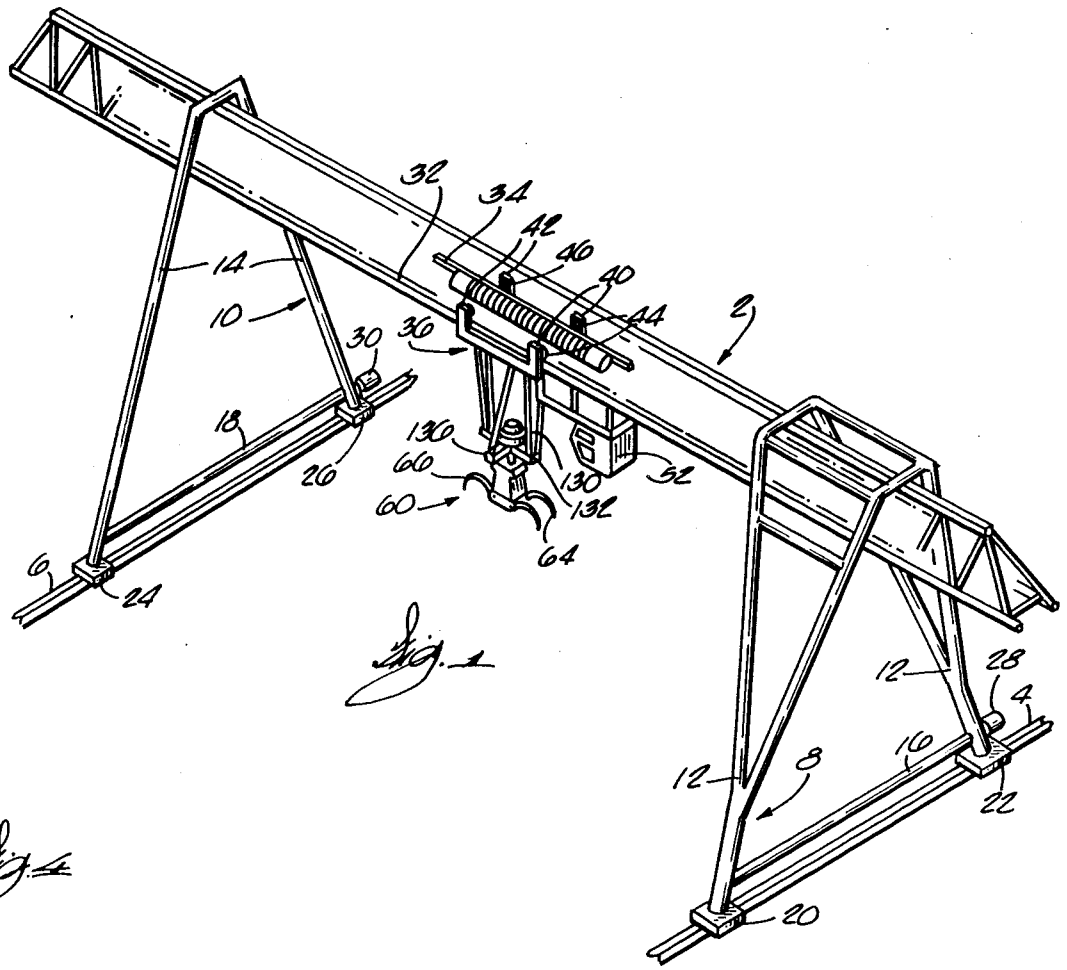
FIG. 1 is a perspective view of a portal crane incorporating the reeving apparatus of the invention.

Referring to FIG. 1 of the drawings, a crane of the portal type incorporating the invention is illustrated as having a frame 2 disposed generally horizontally and overlying two generally parallel rails 4 and 6, a trolley 36, and two spaced-apart legs 8 and 10 affixed to the frame 2. The rails 4 and 6 run through a storage area for material which is to be lifted and transported into and out of the storage area by the crane. The legs respectively include elongated members 12 and 14, lower bases 16 and 18, and spaced-apart wheel assemblies 20, 22, and 24, 26. The wheel assemblies 20, 22 engage and ride on the rail 4 and the wheel assemblies 24, 26 engage and ride on the rail 6, thus permitting the portal crane to travel along the rails 4 and 6 through the material storage area. Drive motors 28 and 30 are respectively mounted on wheel assemblies 22 and 26 for moving the crane along the rails 4 and 6.

The frame 2 includes a pair of parallel tracks 32 and 34 on which a trolley 36 is carried for travel along the length of the frame 2. The trolley 36 includes an overhead frame 38 from which two pair of legs 40 and 42 extend upwardly and on which a pair of trolley support wheels 44 and 46 are mounted. The wheels 44 and 46 engage the tracks 32 and 34 and support the trolley on the tracks. A trolley drive motor 48 is mounted on one of the pair of legs 46 and drives the wheels 42. A guard rail 50 is affixed to the trolley frame 38 for safety purposes during maintenance of the trolley and an operator cab 52 is also mounted on the trolley.

Figure 2:
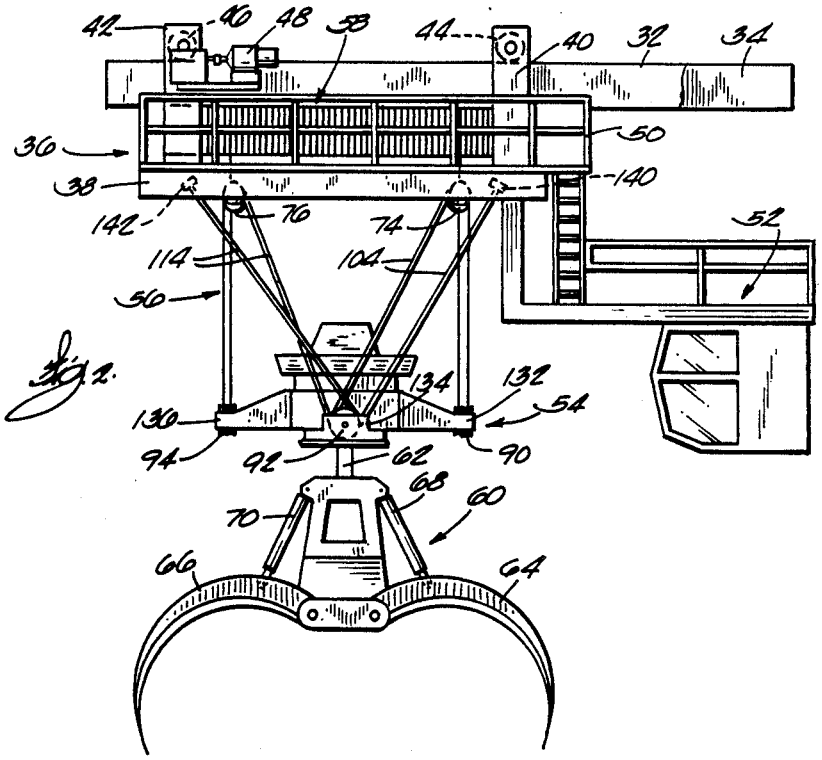
FIG. 2 illustrates a reeving apparatus according to the invention connected between an overhead trolley and a lifting beam from which a load carrying means is suspended.

With reference to FIG. 2, a lifting beam 54 is suspended from the trolley 36 by a reeving apparatus 56 which is affixed to the overhead frame 38 of the trolley, to a winding drum 58 mounted on the trolley frame 38, and to the lifting beam 54. A load carrying means such as a grapple 60 may be rotatably connected to the lifting beam 54 by means of a double articulated joint 62 which permits pivoting of the grapple 60 about perpendicular and horizontal axes. The grapple 60 includes a pair of cylinders 68 and 70 which open and close a pair of load carrying arms 64 and 66 for grasping material to be lifted and transported by the crane. The operation of the grapple 60 including the load carrying arms 64 and 66, the winding drum 58, the movement of the trolley 36, and the movement of the crane on the rails 4 and 6 is controlled from the operator cab 52 to lift, transport and set down material within the travel range of the crane and the trolley.

Figure 4:
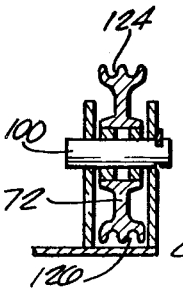
FIG. 4 is an end elevation view, partially in cross-section, of a double grooved sheave utilized in the reeving apparatus of the invention.
Figure 3:
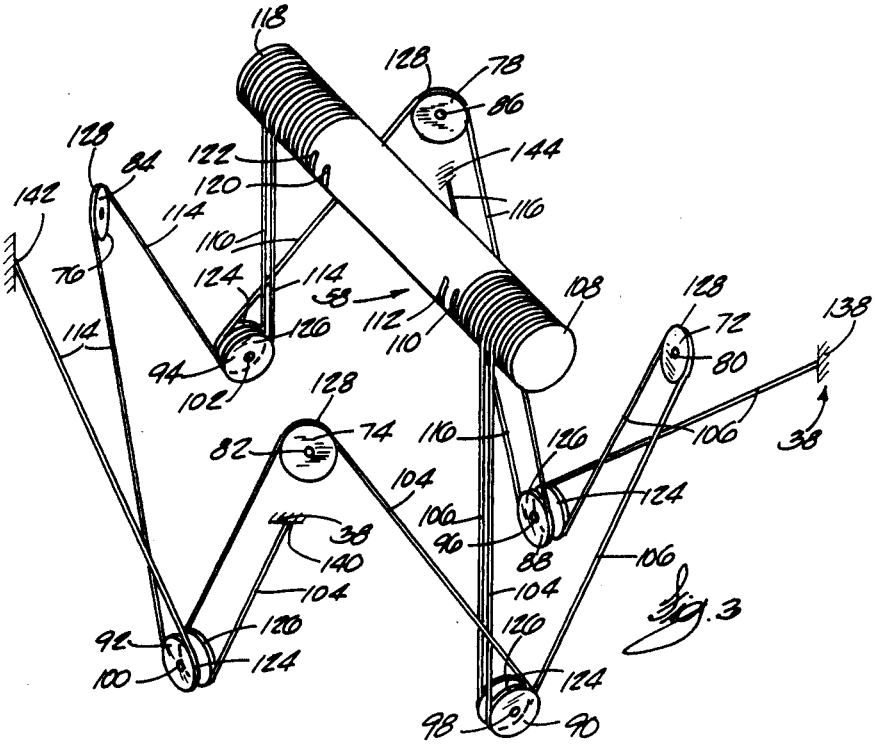
FIG. 3. is a simplified reeving diagram for the reeving apparatus.

The reeving apparatus 56, as shown in FIGS. 2–4, includes upper spaced-apart, single-grooved, rotatable sheaves 72, 74, 76, and 78 which are affixed to the overhead trolley frame 38 by means of their mounting respectively on axles 80, 82, 84 and 86 which are attached to the frame 38. The groove in each of the upper sheaves is designated by the numeral 128. Lower spaced-apart, double-grooved, rotatable sheaves 88, 90, 92, and 94 are affixed to the lifting beam 54 by means of their being respectively mounted on axles 96, 98, 100, and 102 which are attached to the lifting beam 54. The lifting beam 54 is generally cruciform in shape and has ends 130, 132, 134 and 136 adjacent to which the lower sheaves 88, 90, 92 and 94 are respectively affixed to the sheave. The grooves in each of the lower sheaves 88, 90, 92, and 94 are identified by the numerals 124 and 126. A pair or wire ropes 104 and 106 wrap around the winding drum 58 at its end 108 and are affixed to the drum 58 at locations 110 and 112. Another pair of wire ropes 114 and 116 wrap around the other end 118 of the drum 58 and are affixed to the drum 58 at locations 120 and 122.

Each of the wire ropes 104, 106, 114 and 116 follow a separate path including a segment extending from the drum 58 to a lower sheave 90 or 94. As the rope 104 approaches the lower sheave 90 from the drum 58, it wraps around the lower sheave 90 in the groove 124 in a counter-clockwise rotative direction when viewed from the end 132 of the lifting beam 54. The rope 104 then extends from the sheave 90 in a direction toward an upper sheave 74 crossing the path of the rope 104 as it approaches the sheave 90, when viewed in the axial direction of the sheave 90. At the upper sheave 74, the rope 104 wraps around the groove 128 and continues downward to lower sheave 92 and wraps around sheave 92 in groove 126 in a counter-clockwise direction when viewed from the end 134 of the lifting beam 54. The rope 104 then extends upward from the sheave 92 and is affixed to the overhead frame 38 at anchoring location 140. The rope 106 follows another separate reeving path extending between the drum 58 and the lower sheave 90 and wraps around the lower sheave 90 in the groove 126 in the same counter-clockwise rotative direction of the sheave as the wrapping direction of the rope 104. However, the rope 106 extends from the lower sheave 90 at a different angle from the vertical then that of rope 104 and toward the upper sheave 72. In essence, the ropes 104 and 106 diverge from each other relative to the vertical in their upward extending directions from the sheave 90, and generally in the directions of the travel of the crane on the rails 4 and 6. The rope 106 wraps around the sheave 72 in its groove 128 and then extends downwardly to the lower sheave 88. At the lower sheave 88, the rope 106 wraps around the sheave 88 in the groove 124 in a counter-clockwise direction when viewed from the end 130 of the lifting beam 54 and extends upward from the sheave 88 across the path of the rope 106 extending downward to the sheave 88 when viewed in the axial direction of the sheave 88. The upward extension of the rope 106 is attached to the frame 38 at anchor location 138.

The ropes 16 and 114 respectively follow separate paths around sheaves 94, 78, 88 and 94, 84, 92 which are respectively similar to the paths of ropes 104 and 106 as shown in FIG. 3. At lower sheave 88, the rope 116 wraps around the sheave in a groove 126 in the same counter-clockwise rotative direction as the wrapping of rope 106 around sheave 88. However, the rope 116 extends upward away from sheave 88 to anchor location 144 on frame 38 at a different angle from the vertical than the corresponding upward extension of rope 106. The upward extending positions of the ropes 106 and 116 from the sheave 88 is such that they diverge from each other in opposite directions relative to the vertical and generally in the directions of travel of the trolley 36 and the tracks 32 and 34. At lower sheave 92, the rope 114 wraps around the sheave 92 in a groove 124 in the same counter-clockwise rotative direction as the wrapping of rope 104 around sheave 92. However, the rope 114 extends upward at an angle relative to the vertical to anchor location 142 on frame 38. In following this path, rope 114 extends across the path it followed in extending downward to the sheave 92, viewed in the axial direction of the sheave 92. The upward extending positions of the ropes 104 and 114 from the sheave 92 is such that they diverge from each other generally in the directions of travel of the trolley 36 along tracks 32 and 34. At lower sheave 94, the ropes 114 and 116 wrap around sheave 94 respectively in grooves 126 and 124 in the same counter-clockwise direction when viewed from the end 136 of the lifting beam. However, the rope 114 extends upward at an angle relative to the vertical toward upper sheave 76 and the rope 116 extends upward in an opposite direction at an angle from the vertical to sheave 78. In following this path, rope 116 extends across the path it followed in extending downward to the sheave 94, viewed in the axial direction of the sheave 94. The ropes 114 and 116 thus extend upward from sheave 94 in diverging directions and generally in the direction of travel of the crane on the rails 4 and 6.

Acceleration or deceleration, particularly at a rapid rate, by the crane as it travels on the rails 4 and 6 or by the trolley 36 as it travels on the tracks 32 and 34 will result in swaying forces on the lifting beams 54 tending to cause swaying of the lifting beam, load carrying means 60 and any load that it may be carrying in the directions of the crane travel or in the directions of the trolley travel. Also, picking up of unbalanced loads or loads requiring the load carrying means 60 to be positioned at an angle, may result in forces tending to cause rotational swaying about a vertical axis. In the case of attempted swaying in the directions of the crane travel on rails 4 and 6, all or at least a part of the swaying will be prevented by friction forces between sheave 90 and ropes 104, 106 and between sheave 94 and ropes 114, 116 which hold the sheaves 90 and 94 from rotating and are generated in response to the swaying force. The friction forces are the result of and are proportional to the tension on the ropes 104, 106 and 114, 116 due to the friction between the ropes and the grooves 124, 126 in each sheave 90 and 94, and the load of the lifting beam, load carrying means, any load carried by the latter, and swaying forces of the lifting beam, load carrying means and any load. For example, in the view of FIG. 3, sway force on the lifting beam 54 to the right will correspondingly apply force on sheave 90 attempting to rotate it. However, the tension of the rope 104 at the upward diverging angle to the left and the friction of rope 104 along its wrapped around engagement area with groove 124 of sheave 90 provides a friction force along the grooves of the sheave 90 which dissipates the energy of the sway force to the right and thereby inhibits further sway movement to the right or left. If the sway force on the lifting beam 54 is to the left, the tension of rope 106 at the upward diverging angle to the right and the friction of rope 106 with groove 126 of sheave 90 provides a friction force along the grooves of the sheave 90 which dissipates the energy of the sway force and thereaby inhibits further sway movement to the left or right. Since the ropes 104 and 106 wrap around the same single sheave 90 and extend in opposite directions away from the sheave, the combined friction force generated by the two ropes with a single sheave quickly stops swaying movment. Thus, the sway energy is dissipated by friction between the ropes and sheaves along the grooves of the sheave rather than by continued significant sway movement until the sway energy is dissipated in the entire hoist system. The ropes 114, 116 and the sheave 94 function in the same manner as ropes 104, 106 and sheave 90 to prevent sway in the directions of the crane travel. Similarly the ropes 106, 116 wrapped around sheave 88 and the ropes 104, 114 wrapped around sheave 92 function in the same manner as ropes 104, 106 and sheave 90 to prevent sway in the directions of the travel of trolley 36. All of the lower sheaves and ropes function as described with reference to sway in either crane or trolley travel directions to prevent rotational sway movement about a vertical axis.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. A reeving apparatus for a crane having an overhead frame, winding drum means mounted on the frame, and a lifting beam positioned below the frame and subject to saying forces and movement transverse to the vertical comprising:

a plurality of spaced-apart rotatable sheaves affixed to the lifting beam, each of said sheaves having first and second grooves; and a plurality of rope means affixed to the drum means and overhead frame and wrapped around the sheaves for supporting the lifting beam, each of the plurality of rope means including a pair of first and second rope means, the first and second rope means both extending to and wrapping around a different one of the plurality of sheaves respectively in the first and second grooves of the one of the sheaves for generating friction forces with said sheaves which dissipates the energy of the swaying forces on the lifting beam.

2. The reeving apparatus according to claim 1 wherein each of the pairs of the first and second rope means applies force in a radial direction to each said different one of the sheaves in response to swaying movement of the latter.

3. The reeving apparatus according to claim 1 wherein:

each of the plurality of sheaves has an axis; and each of the pairs of first and second rope means are in friction engagement with each said different one of the sheaves for applying force to each said different one of the sheaves inhibiting movement by swaying force in a direction transverse to the axis of each said different one of the sheaves.

4. The reeving apparatus according to claim 3 wherein each of the pairs of first and second rope means are under tension and said friction forces at each sheave are proportional to said tension and the coefficient of friction between each of the pairs of first and second rope means and said different one of the sheaves which they engage.

5. The reeving apparatus according to claim 1 wherein each of the pairs of first and second rope means are under tension and said friction forces at each sheave are proportional to said tension and the coefficient of friction between each of the pairs of first and second rope means and said different one of the sheaves which they engage.

6. A reeving apparatus for a crane having an overhead frame, a lifting beam positioned below and suspended from the frame and subject to swaying forces and movement transverse to the vertical, load carrying means suspended from the lifting beam, and winding drum means mounted on the frame for raising and lowering the lifting beam, the load carrying means and any load carried by the latter, comprising:

a plurality of upper spaced-apart rotatable sheaves affixed to the overhead frame;

a plurality of lower spaced-apart rotatable sheaves affixed to the lifting beam and subject to said swaying forces, each of said lower sheaves having first and second grooves; and rope means affixed to the drum means and overhead frame and wrapped around the upper and lower sheaves for supporting the lifting beam and load carrying means, the rope means including a plurality of pairs of rope means, each pair of rope means comprising first and second rope means following separate paths approaching one of the lower sheaves respectively in the first and second grooves in the same rotative direction of said one of the lower sheaves and extending from the sheave in first and second vertically opposite diverging directions transverse to the axis of said lower sheave and thereby the lifting beam which opposes the swaying forces on the lifting beam and the lower sheaves.

7. The reeving apparatus according to claim 6 wherein each of the plurality of pairs of rope means applies friction forces opposing rotational movement of said one of the sheaves as a result of swaying forces on the latter.

8. The reeving apparatus according to claim 7 wherein:

said swaying forces are substantially in horizontal direction; and the forces of each of the plurality of pairs of rope means include horizontal force components.

9. The reeving apparatus according to claim 6 wherein:

the first and second rope means are each under tension in their respective directions of extension from said one of the lower sheaves; and the first and second rope means are each in friction engagement with said one of the lower sheaves along their respective paths of wrap around said one of the lower sheaves for dissipating the energy of the swaying forces on said one of the lower sheaves.

10. The reeving apparatus according to claim 9 wherein each of the first and second rope means applies friction forces opposing rotational movement of said one of the sheaves as a result of swaying forces on the latter.

11. The reeving apparatus according to claim 10 wherein:

said swaying forces are substantially in horizontal directions; and the forces of each of the first and second rope means include horizontal force components.

12. The reeving apparatus according to claim 6 wherein the first and second diverging directions of extension of the first and second rope means are both upward.

13. The reeving apparatus according to claim 12 wherein the first diverging direction of extension of the first rope means extends across the path of the first rope means approaching said one lower sheave when viewed in the axial direction of said one lower sheave.

14. The reeving apparatus according to claim 13 wherein:

said winding drum means includes a single drum having opposite ends; and one of the pair of first and second rope means extends downward from one end of the drum and another one of the pair of first and second rope means extends downward from the other end of the drum.

15. The reeving apparatus according to claim 6 wherein the winding drum means comprises a single drum overlying the lifting beam.

* * * * *